US005365745A

United States Patent [19]

Caldwell

[11] Patent Number: 5,365,745

[45] Date of Patent: Nov. 22, 1994

[54] PORTABLE LIFE SUPPORT SYSTEM

[75] Inventor: Bruce D. Caldwell, Hitchcock, Tex.

[73] Assignee: Oceaneering International, Inc., Houston, Tex.

[21] Appl. No.: 998,902

[22] Filed: Dec. 30, 1992

Related U.S. Application Data

[63] Continuation of Ser. No. 869,249, Apr. 15, 1992.

[51] Int. Cl.[5] ..... F17C 9/04

[52] U.S. Cl. ..... 62/50.4; 62/259.3; 165/46

[58] Field of Search ..... 165/46; 62/259.3, 50.2, 62/50.4

[56] References Cited

U.S. PATENT DOCUMENTS

| | | | |
|---|---|---|---|
| 2,945,354 | 7/1960 | Moskowitz | 62/50.2 |
| 3,064,448 | 11/1962 | Whittington | 62/50.2 |
| 3,112,724 | 12/1963 | Rosen | 62/48.1 |
| 3,227,208 | 1/1966 | Potter, Jr. et al. | 62/259.3 |
| 3,232,066 | 2/1966 | Peterson et al. | 62/48.1 |
| 3,263,433 | 8/1966 | Fitt | 62/50.2 |
| 3,343,536 | 9/1967 | Brisson et al. | 62/259.3 |
| 3,378,063 | 4/1968 | Mefferd | 62/50.4 |
| 3,570,481 | 3/1971 | Woodberry, Jr. | 62/50.2 |
| 3,797,262 | 3/1974 | Eigenbrod | 62/48.1 |
| 3,984,222 | 10/1976 | DeHaan | 62/48.1 |
| 4,024,730 | 5/1977 | Bell et al. | 62/259.3 |
| 4,172,454 | 10/1979 | Warncke et al. | 62/259.3 |
| 4,286,439 | 9/1981 | Pasternack | 62/259.3 |
| 4,299,091 | 11/1981 | Carter et al. | 62/48.1 |
| 4,633,125 | 12/1986 | Blosser et al. | 313/62 |

FOREIGN PATENT DOCUMENTS 2227879 11/1974 France .

OTHER PUBLICATIONS

"NBPLSS Status Report" Viewgraph Packet, by Willis & Caldwell, dated Aug. 19, 1991, 7 pages.

"NBPLSS Pre-Prototype Un-Manned Testing Quick Look Report" Viewgraph Packet, by Myers & Sprick, dated Dec. 11, 1991, 27 pages.

"NBPLSS Pre-Prototype Un-Manned Testing Quick Look Report" Viewgraph Packet, by Myers & Sprick, dated Dec. 11, 1991, 15 pages.

"NBPLSS Pre-Prototype Un-Manned Testing Quick Look Report" Viewgraph Packet, by Myers & Sprick, dated Feb. 11, 1992, 26 pages.

"Neutral Buoyancy Portable Life Support System Unmanned Testing Report", by Myers & Sprick, dated Jan. 28, 1992, 37 pages.

"Neutral Buoyancy Lab, Portable Life Support System Preliminary Design", by Willis, Caldwell & Sprick, dated Dec. 13, 1990, 59 pages.

"Neutral Buoyancy Lab, Portable Life Support System Directorate Presentation", by Willis, dated Dec. 5, 1990, 14 pages.

"Neutral Buoyancy Lab, Portable Life Support System Directorate Presentation", by Willis, dated Dec. 5, 1990, 47 pages.

"Neutral Buoyancy Lab, Portable Life Support System Project Status Briefing", by Nasa, Lockheed, Ocean Systems Engineering, dated Oct. 4, 1990, 52 pages.

*Primary Examiner*—Ronald C. Capossela

*Attorney, Agent, or Firm*—Vaden, Eickenroht, Thompson, Boulware & Feather

[57] ABSTRACT

The invention in its preferred embodiment is a portable life support system for use in warm water diving providing temperature regulation and breathable atmosphere through cryogenic technology while maintaining neutral buoyancy and trim throughout zero-gravity simulation. The portable life support system comprises: a liquid cooled garment; an externally charged, positive expulsion dewar for storing and delivering liquid cryogen; means for circulating liquid cryogen from said dewar in heat exchange relation with the cooling liquid so as to cool the wearer of the garment and vaporize the liquid cryogen; and means forming a semi-closed breathing loop for delivering breathable gas obtained from the vaporized cryogen from said circulating means to the wearer of said garment for breathing purposes.

5 Claims, 4 Drawing Sheets

AIR LOOP SIDE
LCG SIDE
12
12a
12b
10
14
16
18
19
22a
22b
22c
22d
24
26
27
28
31
32
33
34
35
36
37
38a
38b
38c
38d
38e
39
52
54
106
102
P
V
CO2 SCRUBBER
HUMIDITY CONTROL
VENT/POOL HX

PORTABLE LIFE SUPPORT SYSTEM

The U. S. Government has a paid-up license in this invention and the right in limited circumstances to require the patent owner to license others on reasonable terms as provided for by the terms of contract No. NAS9-17900 awarded by the National Aeronautics and Space Administration.

BACKGROUND OF THE INVENTION

This application is a continuation of my co-pending application Ser. No. 07/869,249 filed Apr. 15, 1992 and also entitled "Portable Life Support System" from which I claim the benefit of an earlier filing date.

FIELD OF THE INVENTION

This invention pertains to a portable life support system and, more particularly, an improved portable life support system employing a liquid cryogen to provide body temperature regulation and breathable atmosphere for the wearer of a liquid cooled garment and space suit during underwater training operations simulating zero-gravity environments.

DESCRIPTION OF THE PRIOR ART

Portable life support systems are typically used in environments that are uninhabitable or otherwise hostile to humans. The two most critical requirements of a portable life support system, from an environmental control perspective, are providing body temperature regulation and a breathable atmosphere for the users. Generally desirable characteristics of personal portable life support systems include a weight that can be carried by a single person, a size that can be carried by a single person without undue loss of mobility, operation without the necessity for an umbilical, and a design that will not impair the dexterity of the user.

Early efforts at portable life support systems were primarily directed at systems having separate subsystems dedicated to either body temperature regulation or breathing, but eventually some used "liquid air" as a cryogenic fluid to provide both body temperature regulation and breathable atmosphere. One early design incorporated a straight semiclosed circuit breathing system in which a breathable atmosphere was generated by vaporizing liquid air. The vaporization process provided minimal cooling and body temperature regulation was achieved through circulation and recirculation of breathable gas obtained from the vaporized cryogen through the user's suit.

A cryogenic fluid may be defined as a fluid which boils (i.e., changes state from liquid to gas) at temperatures less than approximately 110K at atmospheric pressure. Examples of the cryogen include both nitrogen and oxygen (the primary components of "liquid air") as well as hydrogen, helium and methane. As used herein, "cryogen" shall refer to a cryogenic fluid and "cryogenic technology" shall refer to knowledge, techniques, and equipment for harnessing the physical properties of cryogenic fluids to practical applications.

However, cryogenic technology in portable life support systems quickly encountered many technical constraints. Portable life support system technology furthermore diverged from the approach in the early studies to create two schools of thought as the technology matured. One school continued using cryogen for cooling and generating breathable atmosphere. This approach is disclosed in U.S. Pat. No. 3,064,448 issued to P. E. Whittington, U.S. Pat. No. 3,117,426 issued to R. A. Fischer et al., U.S. Pat. No. 3,227,208 issued to V. L. Potter, Jr. et al., and United States Letters Patent 2,990,695 issued to D. A. Leffingwell, Jr.

The divergent school was prompted by efforts to achieve breakthroughs in efficiency and began by separating the body temperature regulation and breathing subsystems. Examples of this school of thought are found in U.S. Pat. No. 4,172,454 issued to Warnecke et al., and U.S. Pat. No. 4,286,439 and 4,459,822 issued to Pastemack. The separation of temperature regulation and breathing subsystems removed technical constraints to permit use of more effective and more dangerous coolants that were not cryogenic fluids. As noted in the '454 Warnecke et al. patent, some in the art switched to solid coolants such as dry ice instead of cryogenic fluids.

One of the primary difficulties that led to the divergence of thought was that the early applications of cryogenic technology could not produce high efficiencies in terms of adequate and controllable body cooling and duration per unit weight. I have discovered that the source of this problem was ineffective heat exchange. Cooling was primarily provided by heat exchange between circulating air and the user's body, i.e., in a gas phase loop. My invention takes advantage of the fact that heat exchange in a liquid phase loop is far superior to heat exchange in a gas phase loop. This superiority arises from a number of factors, foremost of which is greater control over the heat exchange process.

A second difficulty that still plagues cryogenic life support systems arises from the reliance of such systems on user orientation relative to the field of gravity. Breathable atmosphere subsystems employing air under pressure, such as SCUBA, are "orientationally independent" because the gas under pressure will expand through its natural properties to provide constant supply to the user. However, liquids perform fundamentally differently and require a motive force for delivery to the point of heat exchange where they vaporize. Many cryogenic systems known heretofore employ gravity by storing the liquid cryogen relative to the point of heat exchange and current "orientationally independent" delivery systems are inefficient and costly.

Current systems deliver the dewar contents by separating the vaporized cryogen in the dewar, which is then pressurized, and the liquid cryogen, which is expelled by the force exerted by pressurized vaporized cryogen in the dewar. The separation results from the differing effects of gravity on liquid cryogen and vaporized cryogen and operates to separate them. An intake port in the dewar is submerged by the separated liquid cryogen which is then delivered in response to a pressure differential. Relying on gravity therefore causes a marked decrease in performance because whenever the system user affects the orientation of the delivery with respect to the gravitational field, the dewar contents lose pressurization and delivery becomes less effective as the vaporized cryogen is rapidly vented through the intake port which is no longer submerged in the liquid cryogen.

Thus, the inability to achieve effective heat transfer and to develop a satisfactory orientationally independent delivery caused some in the art to abandon cryogenic technology or to adopt undesirable but necessary alternatives. These shortcomings affected both primary functions of the system and resulted in the functional division of the system as first proposed in the 1960's into separate, functionally dedicated, subsystems. This, in turn, led to the return of compressed gas for breathable atmospheres and dangerous liquid coolants, and even solid coolants, for temperature regulation.

Portable life support systems are of concern for national space programs not only because of applications in space, but also because of astronaut training in large underwater facilities. Underwater training facilities are used for simulating activities in zero-gravity environments during space missions and so safe training under conditions as near to those found in space as is possible is a major goal. Life support for trainees during underwater training is provided by an umbilical, which degrades the quality of the simulation in two significant ways. First, the umbilical prevents trainees from entering and exiting spacecraft mock-ups in the same manner as in space, primarily by preventing the closure of hatches through which the trainee must enter and exit the mock-up. Second, the umbilical interferes with the maintenance of neutral buoyancy and trim by imparting additional forces to the trainee other than gravity, which are necessary to simulate the condition in zero-gravity that a motionless object in zero-gravity does not translate or rotate.

The umbilical also introduces some inherent safety risk during training, because the umbilical necessarily follows the trainee as the trainee moves through and about the mock-up. A trainee needing to make an emergency ascent must therefore either retrace the path out of the mock-up or disconnect from the umbilical. Although the risk is not great because of relatively shallow depths and assistance available from support divers, it is preferable to remove the risk if possible.

A portable life support system eliminating the use of umbilicals is therefore very desirable. However, the goal of maximizing simulation accuracy imposes still further requirements beyond those mentioned above. The system must maintain a constant pressure differential in the space-suit over ambient hydrostatic pressure to simulate operation of a pressurized suit in a vacuum environment such as in space. The system must emulate space flight equipment such as pressure suits and backpacks and for relatively long periods of time. Furthermore, simulations are typically run in warm water so that support divers do not need to wear wet suits and so the system must provide adequate cooling to the trainee.

It is therefore an object of this invention to overcome the aforementioned problems with effective heat transfer and orientationally independent delivery with a portable life support system employing cryogenic technology that effectively combines body temperature regulation and delivery of a breathable atmosphere.

It is furthermore an object of the present invention that it maximizes desirable characteristics of neutral buoyancy, size, and design, and eliminates the umbilical for both body temperature regulation and breathing in a portable life support system for use underwater.

It is furthermore an object of this invention that it provides a portable life support system maintaining neutral buoyancy and trim to simulate zero-gravity environments during underwater training.

It is a still further object of this invention to provide a portable life support system maximizing simulation of zero-gravity operations in a space environment.

SUMMARY OF THE INVENTION

The invention in its preferred embodiment is a portable life support system for use in warm water diving providing temperature regulation and breathable atmosphere through cryogenic technology while maintaining neutral buoyancy and trim throughout zero-gravity simulation. The portable life support system comprises: a liquid cooled garment; an externally charged, positive expulsion dewar for storing and delivering liquid cryogen; means for circulating liquid cryogen from said dewar in heat exchange relation with the cooling liquid so as to cool the wearer of the garment and vaporize the liquid cryogen; and means forming a semi-closed breathing loop for delivering breathable gas obtained from the vaporized cryogen from said circulating means to the wearer of said garment for breathing purposes.

BRIEF DESCRIPTION OF THE DRAWINGS

A more particular description of the invention briefly summarized above can be had by reference to the preferred embodiment illustrated in the drawings of this specification so that the manner in which the above cited objects, as well as others that will become apparent, are obtained and can be understood in detail. The drawings illustrate only a preferred embodiment of the invention and are not to be considered limiting of its scope as the invention will admit to other equally effective embodiments.

In the drawings.

DESCRIPTION OF THE PREFERRED EMBODIMENT

Figure 1:
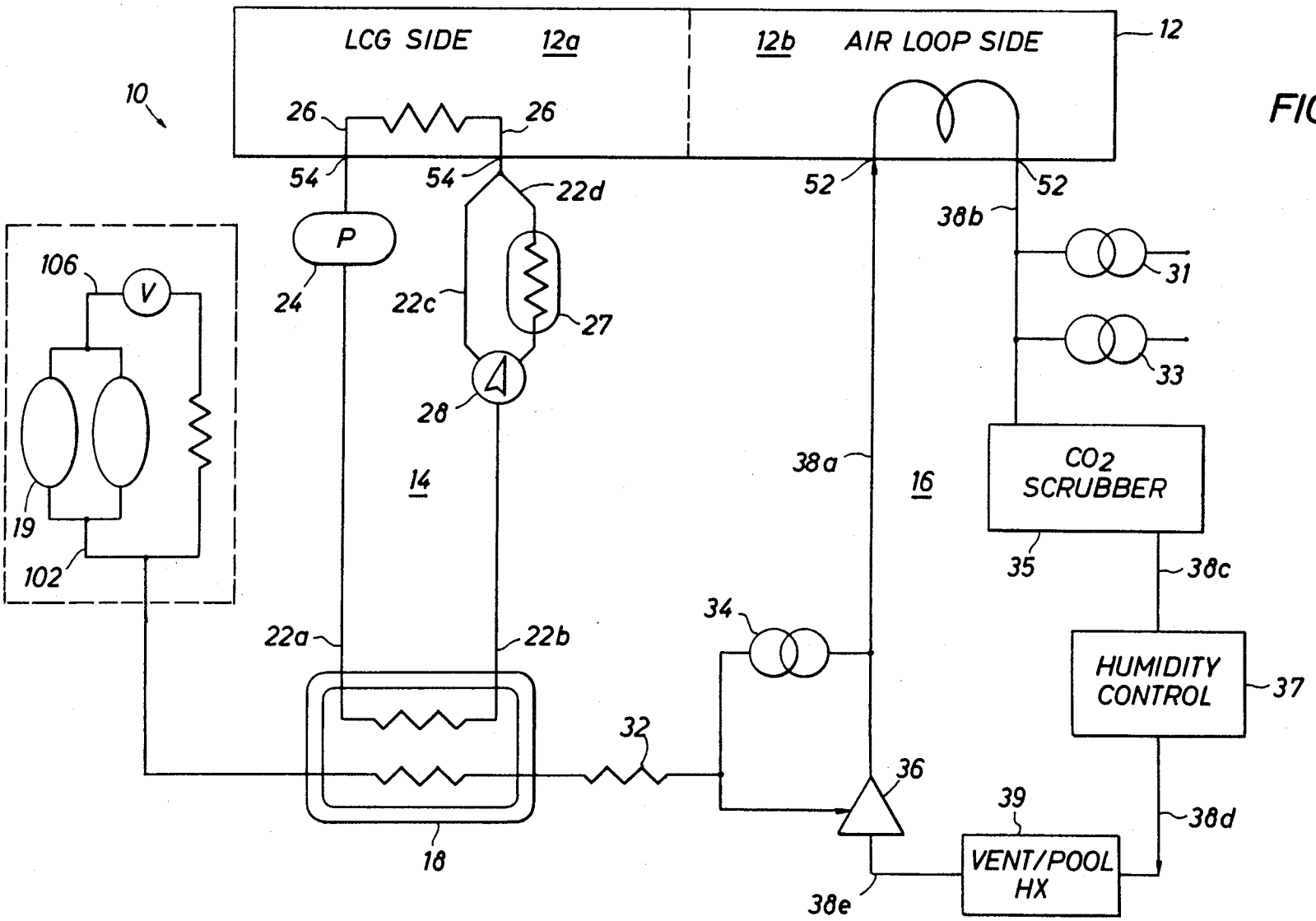
FIG. 1 is a schematic illustration of the portable life support system of the present invention.

The system of FIG. 1, generally denoted 10, is a portable life support system for use in underwater simulation of zero-gravity operations in vacuum environments such as space. Portable life support system 10 is generally comprised of garment 12, cooling loop 14, breathing loop 16, heat exchanger 18, and dewars 19. Garment 12 in the preferred embodiment is worn by the user inside suit 80 (best shown in FIG. 3) which isolates the user from the surrounding environment. However, the functions of garment 12 and suit 80 may be combined in some embodiments.

As described below, dewars 19 are designed to provide neutral buoyancy and trim. Heat exchanger 18 and dewars technically can be considered as a part of both cooling loop 14 and breathing loop 16 since their functions are required by both, but are treated separately to facilitate discussion of the operation of system 10 as a whole. Suit pressurization regulator 34, overpressure relief regulator 31, and back pressure regulator 33 provide pressure regulation to maintain suit pressure of suit 80 at a constant pressure differential over ambient pressure within system 10 in response to pressure fluctuations in the environment in a manner well known to the art.

In operation, dewars 19 store liquid cryogen and deliver the liquid cryogen to heat exchanger 18. In the preferred embodiment the liquid cryogen is "liquid air", essentially liquid oxygen diluted with liquid nitrogen, but other cryogens may be acceptable. Cooling loop 14 is a closed liquid loop, the cooled liquid of which absorbs the heat from the wearer's body and transfers the absorbed heat to the liquid cryogen delivered by dewars 19 to heat exchanger 18. The liquid cryogen vaporizes and the vaporized cryogen is warmed (as explained below) as the heat is transferred from the cooled liquid. The warmed vaporized cryogen is then delivered to the user as breathable atmosphere via breathing loop 16.

Figure 3:
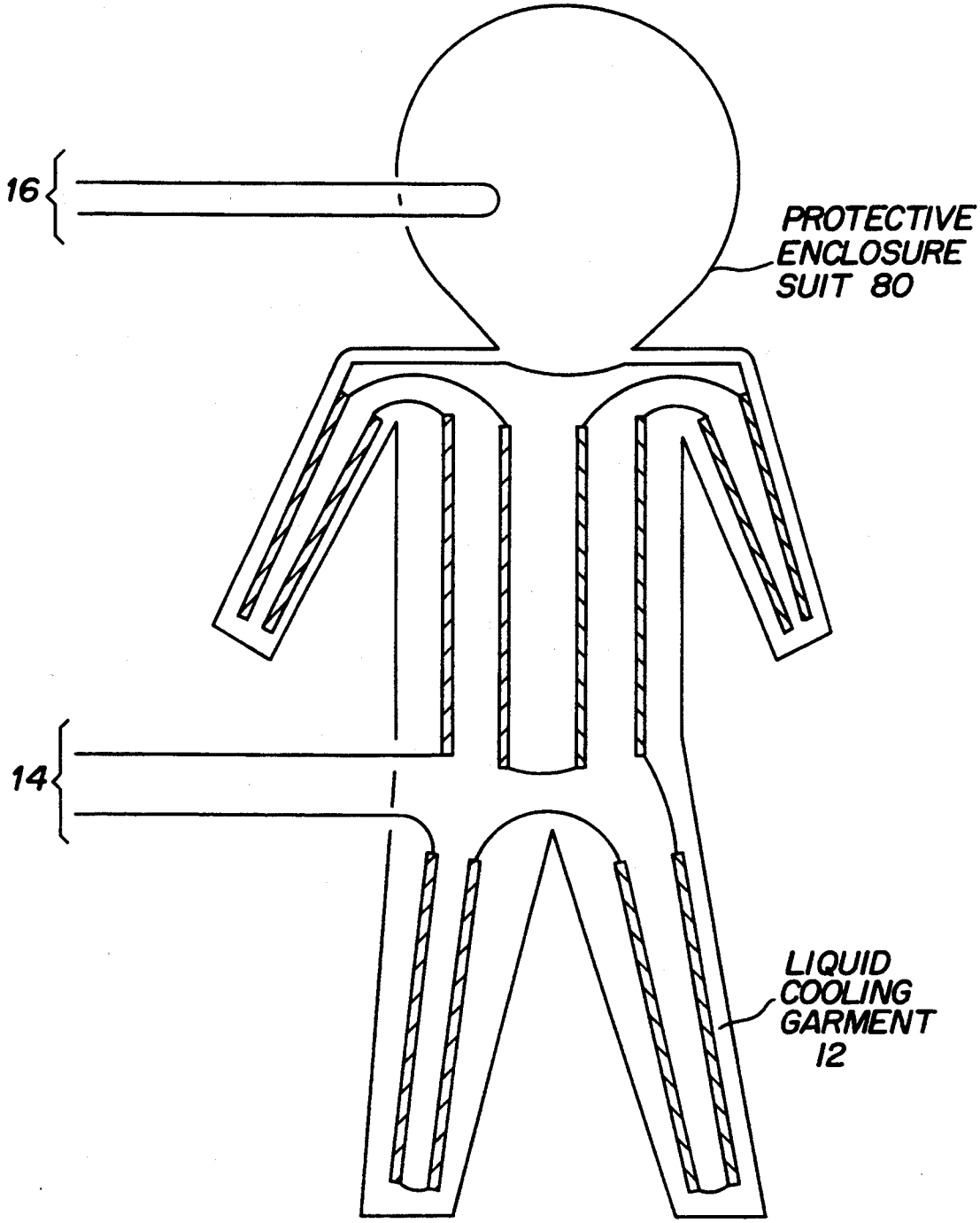
FIG. 3 illustrates the relationship between the liquid cooled garment of the invention and the protective enclosure suit of the preferred embodiment.

Body temperature regulation for the wearer of garment 12 is provided via temperature control of the cooled liquid circulated through cooling loop 14. As best shown in FIG. 3, garment 12 is comprised of liquid cooled garment 12 and an outer protective garment, referred to as a "suit", 80 which provides environmental isolation for the wearer of garment 12, both as are commonly known in the art. As such, garment 12 has a number of "tubes" sewn into it that comprise a series of arteries to conduct a cooled liquid, such as water, in a predetermined pattern over the body of the person wearing the garment. These "tubes" are functionally represented as garment line 26 in FIG. 1 and are best shown in FIG. 3. The cooled liquid absorbs the heat of the wearer's body as it courses through the tubes, thereby warming the liquid and cooling the wearer through heat exchange. The tube suit which comprises garment 12 is merely one means by which a conduction heat exchange relationship with the wearer's body and other means may be equally acceptable.

Cooling loop 14 comprises insulated lines 22a–b, water pump 24, and garment line 26. Water pump 24 provides the motive force that pumps the cooled liquid throughout cooling loop 14. Temperature control for the water in cooling loop 14 is provided by cooling control valve 25 and heat exchanger 18. Cooling control valve 25 can be any one of many known in the art and is operated by the user to increase or decrease cooling. When the temperature of the liquid in loop 14 is too warm, cooling control valve 25 permits fluid flow into breathing loop 16. This draws additional liquid cryogen through heat exchanger 18 whereupon the heat exchange between the liquid in loop 14 and the liquid cryogen in heat exchanger 18 further cools the temperature of the liquid in cooling loop 14. Otherwise, cooling control valve 25 blocks fluid flow and breathable atmosphere obtained from the vaporized cryogen enters breathing loop 16 through alternative parallel paths in response to accommodate the user's breathing needs and in response to suit pressurization needs during descent. The desired average temperature of the cooled liquid in cooling loop 14 may vary depending upon factors such as the anticipated level of activity and the temperature of the water in which the user is diving, but should generally be at least less than the standard 91° F. skin temperature of the human body and preferably within 55°–80° F.

Breathing loop 16 comprises excess cryogen vaporizer 32, suit pressurization regulator 34, ejector 36, lines 38a–e, overpressure relief regulator 31, back pressure regulator 33, carbon dioxide scrubber 35, humidity control 37, and auxiliary heat exchanger 39. Excess cryogen vaporizer 32 performs two vital safety functions. First, not all of the liquid cryogen delivered by dewars 19 to heat exchanger 18 is necessarily vaporized, especially if cooling loop 14 malfunctions, and so vaporizer 32 ensures that no liquid cryogen enters the breathing loop to harm the user. Second, vaporized cryogen can be as cool as −300° F. so vaporizer 32 warms the vaporized cryogen to a breathable temperature. Once all liquid cryogen is vaporized and warmed, it is introduced to breathing loop 16 via alternative paths through suit pressurization regulator 34, cooling control valve 25, and ejector 36.

Breathing loop 16 of system 10 is a semi-closed circuit and so significant amounts of exhaled atmosphere are vented and significant amounts are recycled. Ejector 36 provides the motive force for recycling the exhaled atmosphere in a manner well known to those of ordinary skill in the art through momentum transfer of a high velocity gas jet without moving parts. Carbon dioxide scrubber 35 removes carbon dioxide from recycled, exhaled breathable atmosphere and humidity control 37 removes moisture introduced to the exhaled atmosphere by the metabolic processes of the user. Humidity control 37 in the preferred embodiment is a desiccant bed as is well known in the art, but alternatives may be acceptable. Indeed, some embodiments may not need humidity control, in which case humidity control 37 can simply be removed from breathing loop 16.

Suit pressurization regulator 34, overpressure regulator 31 and back pressure regulator 33 operate in conjunction to control the relative pressure in the suit in response to fluctuations in the operating environment's absolute pressure in a manner well known to those in the art. Pressure regulation is generally necessary if the suit pressure is to be maintained at a pressure differential above ambient and/or the external pressure is variable. Overpressure regulator 31 and back pressure regulator 33 simulate operation in a vacuum by maintaining a constant suit pressure differential over ambient pressure.

Auxiliary heat exchanger 39 provides some temperature regulation by selectively exposing the circulating atmosphere to the temperature of the water in which the user is diving for removing heat from exothermic carbon dioxide and water absorption. Thus, the primary purpose of auxiliary heat exchanger 39 is to dump heat from the vaporized cryogen introduced into breathing loop 14 by scrubber 35. Auxiliary heat exchanger 39 may therefore be omitted in some embodiments where there is no need to dump such heat.

Carbon dioxide scrubber 35, suit pressurization regulator 34, overpressure regulator 31, and back pressure regulator 33 may each be any one of several known and commonly available to those in the art. None of the common alternatives for these components is particularly preferred over the others. Where necessary, humidity control is generally preferred to be a desiccant bed for underwater applications as is commonly known and available to those in the art, although other forms of humidity control may be acceptable or even desirable in other embodiments.

Figure 2B:
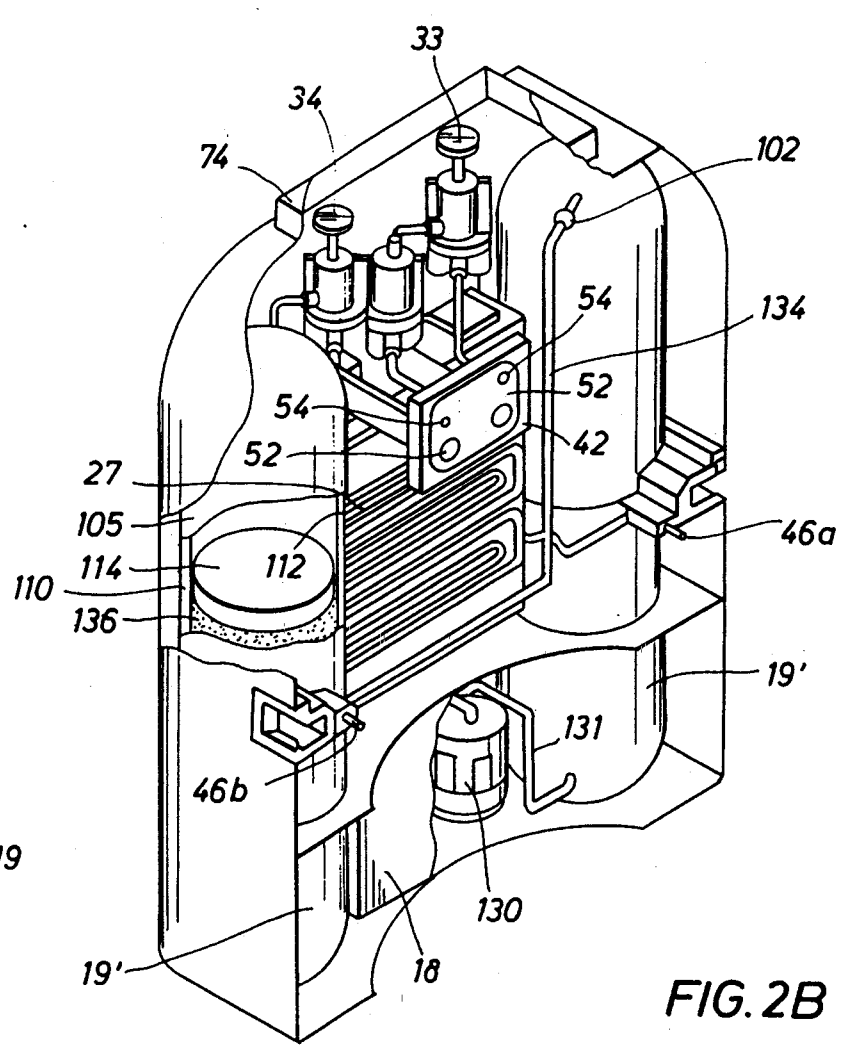
FIGS. 2A and 2B are cutaway, perspective illustrations of a part of a portable life support system that is worn on the back of someone using the system of FIG. 1 and how it interfaces with the rest of the embodiment comprising the garment and those elements not worn on the back.
Figure 2A:
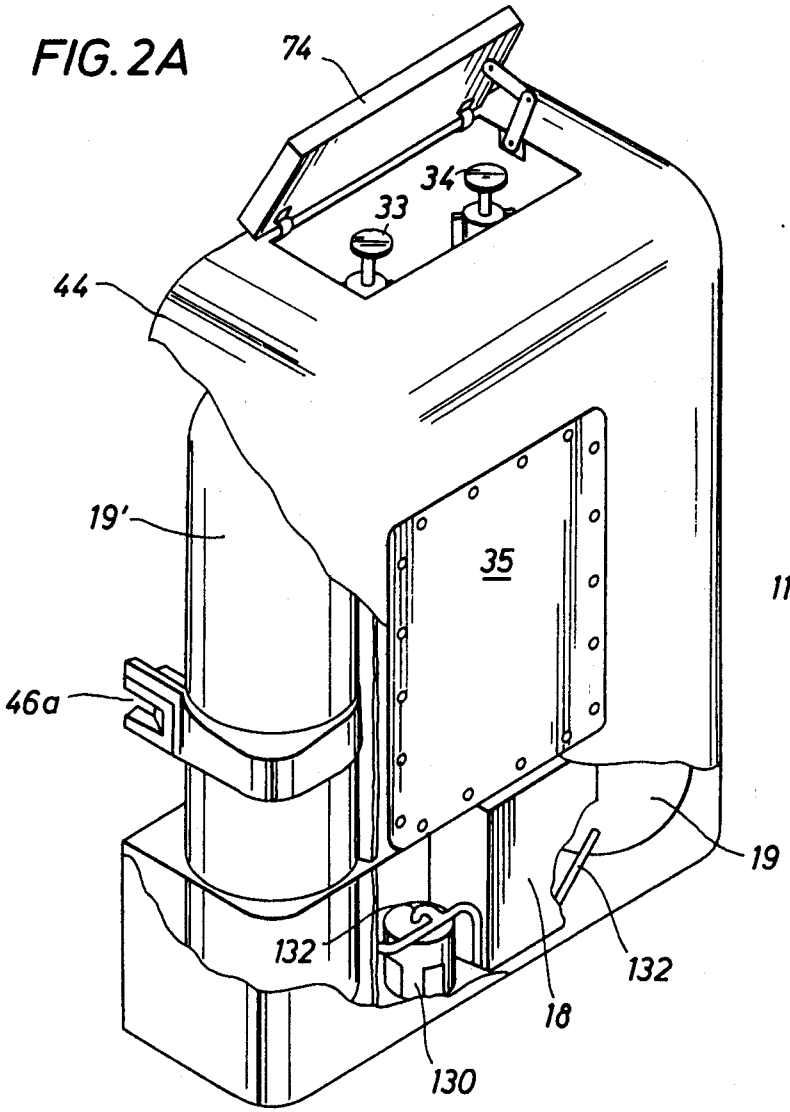

FIGS. 2A and 2B are graphical illustrations of components of system 10 in FIG. 1 that may be worn on the back of the user. The components are mounted in housing 44 and communicate with garment 12 through suit 80 via interface plate 42. Interface plate 42 has ports 52 through which breathing loop 16 enters and leaves the suit for ventilation and ports 54 through which cooling loop 14 enters and leaves the suit to cool the wearer.

The "backpack" configuration of FIGS. 2A–B is especially designed to be mounted to a suit (typically called the "SSA", or "space suit assembly") currently used by the National Aeronautics and Space Administration of the United States of America for the Space Transportation System and in its underwater training programs, which is the preferred embodiment of suit 80. Housing 44 is mounted to the hard upper torso of the SSA (not shown) worn by the user of system 10 via mounting means 46a–b and several screw connections (not shown) in interface plate 52 in a manner well known to those in the art. The SSA with housing 44 mounted thereto then constitutes what is known as the extra-vehicular mobility unit ("EMU").

Figure 4:
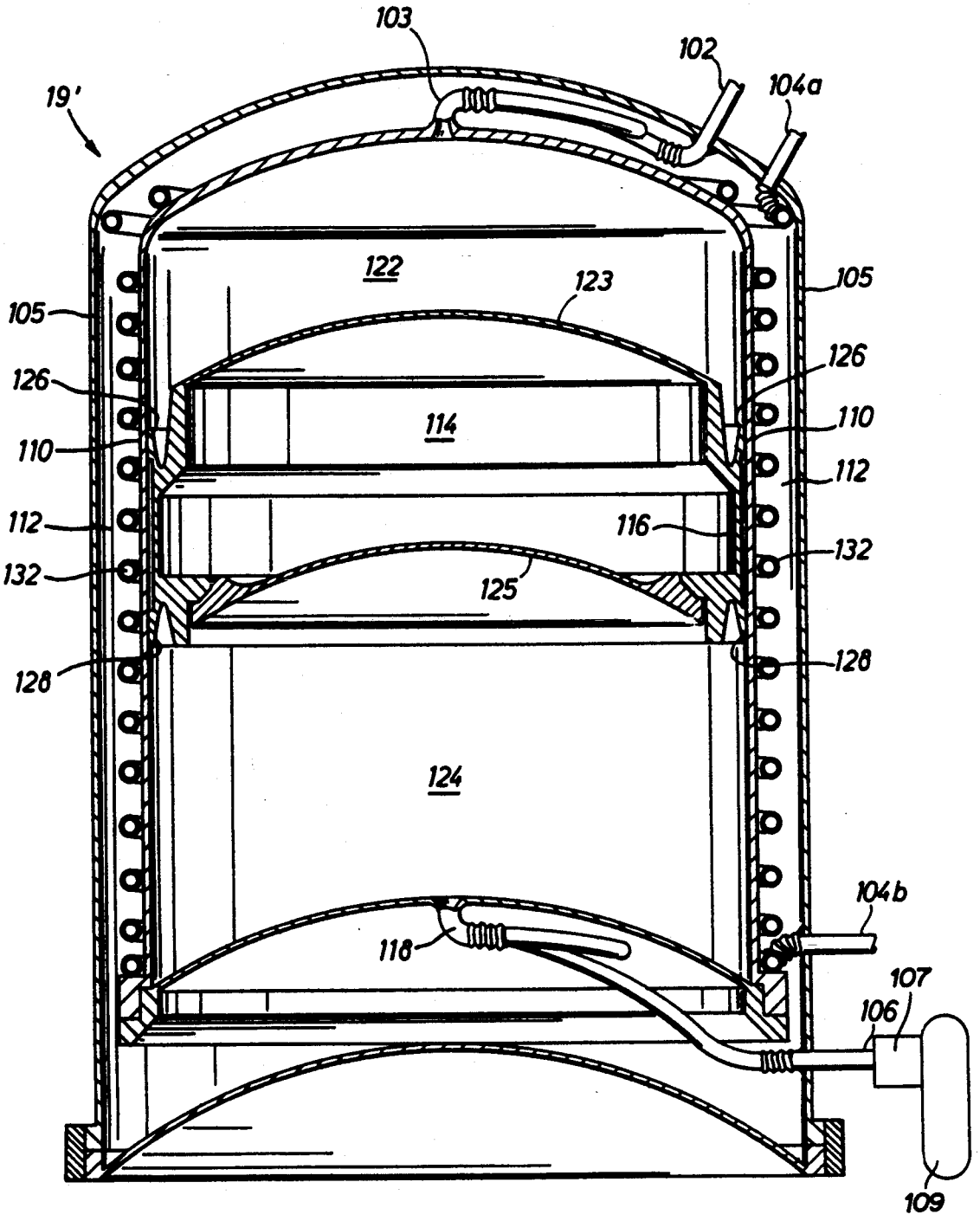
FIG. 4 is a cross-sectional illustration of an externally chargeable positive expulsion dewar as is also shown in FIGS. 2A–2B in an alternative embodiment.

FIG. 4 illustrates one of dewars 19 in FIG. 1 in a cross-section. Technically, a "dewar" is understood in the art to mean a vessel for containing liquid cryogen. However, dewars 19 each provide a mechanism for positively expelling the liquid cryogen stored therein from the dewar to its associated delivery lines. These embodiments are therefore more properly called "positive expulsion dewars". In this manner, the positive expulsion dewar both stores and delivers liquid cryogen for either the breathing loop, the cooling loop, or both as in the preferred and illustrated embodiments of this invention. The term "dewar" as used herein with reference to the claimed invention shall be understood to mean "positive expulsion dewar."

Positive expulsion dewars for use in zero-gravity simulation must also maintain neutral buoyancy and trim as mentioned above. There are therefore two alternative approaches to positive expulsion dewar design. First, the dewar design may include a piston driven by pressurized water. Second, the piston may be gas charged and compensated with weights by a support diver. The gas charged piston design is illustrated in FIG. 4 and discussed immediately below followed by a discussion of the pressurized water design illustrated in FIGS. 2 and 2A–2B.

FIG. 4 is a cross-sectional view of positive expulsion dewar 19 that is externally pressurized and which employs a gas charged piston mechanism. Piston 114 is movably disposed within inner pressure vessel 110 which, in turn, is mounted within outer pressure vessel 105 using a cantilevered spoke design (not shown). The cantilevered spokes run from the exterior surface of inner pressure vessel 110 to the interior surface of outer pressure vessel 105 in chamber 112. Inner pressure vessel 110 can be mounted within outer pressure vessel 105 using equally satisfactory alternatives to cantilevered spokes, such as straps or webbing, as are well known in the art for minimizing the heat conduction paths from outer pressure vessel 105 to inner pressure vessel 110. Inner pressure vessel 110 in the preferred embodiment is an Inconel or 304L stainless steel pressure vessel whose contents are insulated by a vacuum induced in chamber 112 between inner pressure vessel 110 and outer pressure vessel 105.

Piston 114 is preferably constructed as a single unit from one or more materials exhibiting low conductivity and expansion characteristics in both structural and sealing applications, such as KEL-F81 or ultra high molecular weight polyethylene (UHMWPE). The internal volume of piston 114 is evacuated and filled with alternating layers of multi-layer insulation for additional insulation of the liquid cryogen as is well known to those in the art. Piston 114 is portrayed in FIG. 4 in a position indicating that the liquid cryogen contents are three-quarters expelled. Piston 114 defines upper chamber 122, annular chamber 116, and lower chamber 124, by virtue of sealing engagement between annular flange 126 and annular flange 128 and the interior surface of inner pressure vessel 110. The pressure of the contents of chamber 122 exerts a force against forward side 123 of piston 114 and the contents of chamber 124 exert a force against reverse side 125 of piston 114.

Liquid cryogen is introduced into and delivered from upper chamber 122 via port 102 and line 103. Prior to filling, piston 114 is retracted by increasing the pressure in chamber 122 relative to chamber 124, whereupon chamber 122 is filled with liquid cryogen. Liquid cryogen is then delivered via line 103 and port 102 to the system heat exchanger such as heat exchanger 18 in FIG. 1 by supplying pressurized gas to chamber 124 which applies force to piston 114, thereby pressurizing the liquid cryogen in chamber 122. Pressurized gas is supplied to lower chamber 124 from external supply 109 by pressure regulator 107 and line 106.

A gas pressure sufficiently high to positively expel liquid cryogen from upper chamber 122 must be maintained in lower chamber 124. Typically, "sufficiently high" simply means a greater pressure in lower chamber 124 than in upper chamber 122 to overcome frictional forces between annular flanges 126 and 128 and the wall of inner vessel 110. One method employs an external pressure vessel 100 containing gas under pressure and a pressure reducing valve 107 to ensure that a constant gas pressure is supplied to lower chamber 124. As piston 114 moves upward and reduces the pressure of the gas in the increased volume of lower chamber 124, the pressure reducing valve allows more gas from the external pressure vessel to enter lower chamber 124 to maintain sufficient gas pressure. The amount of force for positively expelling liquid cryogen can be simply controlled by adjusting the pressure reducing valve to obtain a desired pressure level in lower chamber 124 and, hence, upper chamber 122 (less the pressure differential arising from frictional forces).

FIGS. 2A–B illustrate an alternative to gas charging dewar 19. Dewar 19, in the preferred embodiment when water charged as shown in FIGS. 2A–B and discussed below, includes rubber bellows (not shown) in lower chamber 124 to help prevent contamination and warming of liquid cryogen in upper chamber 122, as piston 114 as liquid air is expelled. Rubber bellows also help compensate for the small difference in densities between water and liquid air. If rubber bellows are employed, the annular space between rubber bellows and the wall of chamber 124 must be pressure compensated to minimize any pressure differential across the bellows. The system includes dewar pressurization pump 130 (shown only in FIGS. 2A–2B) which pumps water 136 obtained from the environment into the lower chamber of dewar 19 defined by piston 114 via line 131 to maintain the differential pressure in dewar 19 during operations. This pressurization technique has the added advantage over gas-charging of maintaining neutral-buoyancy and trim of the user without resorting to extra measures such as adding lead weights because the density of the liquid oxygenliquid nitrogen mixture is similar to that of water, and is therefore preferred over gas charging or self-pressurizing.

Before filling operations begin, the temperature of inner pressure vessel 110 is generally higher than cryogenic temperatures and so either some liquid cryogen introduced into upper chamber 122 will boil off to cool inner pressure vessel 110 and piston 114 or inner pressure vessel 110 and piston 114 must be pre-cooled. Chamber 112 therefore contains cooling coil 132 used for pre-cooling inner pressure vessel 110 before liquid cryogen is introduced.

Liquid cryogen for pre-cooling enters cooling coil 132 through port 104*a* and exits via port 104*b* and cools inner pressure vessel 110 prior to its fill or recharge. This reduces and minimizes vaporization (or "boil off") of liquid cryogen introduced into upper chamber 122 of inner pressure vessel 110 during filling operations. Cooling coil 132 may be used with a closed-cycle refrigerator for pre-cooling operations.

However, in applications where there is no need to minimize consumable waste and boil off of liquid cryogen is acceptable, pre-cool may be omitted altogether. It is therefore evident the invention claimed herein may have alternative, equally satisfactory embodiments without the departing from the spirit or essential characteristics thereof. The preferred embodiments disclosed above must consequently be considered illustrative and not limiting of the scope of the invention as it may admit to other equally effective embodiments.

What is claimed is:

1. A portable life support system for underwater simulation of zero-gravity and low gravity activities, comprising:

a garment through which liquid coolant may be circulated to cool a wearer of the garment;

an externally charged, positive expulsion dewar for storing and delivering liquid cryogenic fluid while maintaining neutral bouyancy and trim;

means for circulating liquid cryogenic fluid expelled from said dewar in heat exchange relation with the liquid coolant so as to cool the wearer of the garment and vaporize the liquid cryogenic fluid; and means forming a semi-closed breathing loop for delivering warmed, vaporized cryogen from said circulating means to the wearer of said garment for breathing purposes.

2. The portable life support system of claim 1, wherein the heat exchanging means comprises:

an insulated housing;

a loop for circulating the cooling liquid through the interior of the garment and the housing; and means for circulating liquid cryogen through the housing intermediate the source and the delivering means.

3. The portable life support system of claim 1, wherein the dewar comprises:

a thermally insulated pressure vessel having a first port and a second port;

a piston having a forward side and an reverse side and sealably reciprocable in said pressure vessel in response to a force exerted on the forward side by the pressure of liquid cryogen received through the first port and a force exerted against the reverse side; and means for supplying fluid to said piston through the second port at a pressure which exerts a force against the reverse side of said piston that is greater than the force exerted on the forward side.

4. The portable life support system of claim 3, wherein the supplying means comprises:

a source of gas under pressure, and valving means for selectively charging the dewar with gas from the source.

5. The portable life support system of claim 3, wherein the supplying means comprises:

a source of liquid, and pumping means for selectively charging the dewar with liquid from the source.

* * * * *